US010632635B2

(12) United States Patent
Kim et al.

(10) Patent No.: US 10,632,635 B2
(45) Date of Patent: Apr. 28, 2020

(54) RAZOR

(71) Applicant: DORCO CO,. LTD., Seoul (KR)

(72) Inventors: Dong Il Kim, Seoul (KR); Byung Sun Ahn, Seoul (KR)

(73) Assignee: DORCO CO,. LTD., Seoul (KR)

( * ) Notice: Subject to any disclaimer, the term of this patent is extended or adjusted under 35 U.S.C. 154(b) by 97 days.

(21) Appl. No.: 15/983,730

(22) Filed: May 18, 2018

(65) Prior Publication Data

US 2018/0264668 A1 Sep. 20, 2018

Related U.S. Application Data

(63) Continuation of application No. PCT/KR2015/012534, filed on Nov. 20, 2015.

(30) Foreign Application Priority Data

Nov. 20, 2015 (KR) ..... 10-2015-0163126

(51) Int. Cl.
*B26B 21/40* (2006.01)
*B26B 21/52* (2006.01)
*B26B 21/22* (2006.01)

(52) U.S. Cl.
CPC ..... *B26B 21/4012* (2013.01); *B26B 21/225* (2013.01); *B26B 21/521* (2013.01)

(58) Field of Classification Search
CPC ..... B26B 21/08; B26B 21/14; B26B 21/22; B26B 21/222; B26B 21/225; B26B 21/40; B26B 21/4012; B26B 21/52; B26B 21/521

(Continued)

(56) References Cited

U.S. PATENT DOCUMENTS 5,206,994 A * 5/1993 Lin ..... B26B 21/523 30/47
5,333,382 A * 8/1994 Buchbinder ..... B26B 21/22 30/47

(Continued)

FOREIGN PATENT DOCUMENTS

EP 1245351 10/2002
EP 2148765 2/2010

(Continued)

OTHER PUBLICATIONS

The State Intellectual Property Office of the People's Republic of China Application Serial No. 201580084718.6, Office Action dated Apr. 23, 2019, 6 pages.

(Continued)

*Primary Examiner* — Jason Daniel Prone
(74) *Attorney, Agent, or Firm* — Lee, Hong, Degerman, Kang & Waimey

(57) ABSTRACT

A razor includes a cartridge main body, a front of the cartridge main body and a rear of the cartridge main body are partially open, a connector mounting part which includes a first connecting part integrally formed on the rear of the cartridge main body and a second connecting part integrally formed on the rear of the cartridge main body and spaced apart from the first connecting part, a holder mounting part which is integrally formed on the rear of the cartridge main body and positioned between the first connecting part and the second connecting part, and a handle assembly which includes a handle body held by a user and a holder pivotally positioned on an upper side of the handle body and detachably connected to the holder mounting part.

10 Claims, 8 Drawing Sheets

(58) Field of Classification Search
USPC ..... 30/47–51, 527
See application file for complete search history.

(56) References Cited

U.S. PATENT DOCUMENTS 5,669,139 A * 9/1997 Oldroyd ..... B26B 21/222 30/47
5,687,485 A 11/1997 Shurtleff et al.
5,761,814 A 6/1998 Anderson et al.
5,956,848 A 9/1999 Tseng et al.
5,956,851 A 9/1999 Apprille et al.
6,041,926 A 3/2000 Petricca et al.
6,052,903 A 4/2000 Metcalf et al.
6,185,822 B1 2/2001 Tseng et al.
6,212,777 B1 4/2001 Gilder et al.
6,425,184 B1 * 7/2002 Min ..... B26B 21/225 30/51
6,442,839 B1 9/2002 Tseng et al.
6,516,518 B1 2/2003 Garraway et al.
6,612,040 B2 9/2003 Gilder
6,684,513 B1 2/2004 Clipstone et al.
7,526,869 B2 * 5/2009 Blatter ..... B26B 21/225 30/50
7,770,294 B2 * 8/2010 Bruno ..... B26B 21/225 30/50
7,966,731 B2 * 6/2011 Walker ..... B26B 21/225 30/50
8,033,023 B2 * 10/2011 Johnson ..... B26B 21/225 30/50
8,096,054 B2 * 1/2012 Denkert ..... B26B 21/225 30/50
8,205,343 B2 * 6/2012 Winter ..... B26B 21/521 30/50
8,359,751 B2 * 1/2013 Efthimiadis ..... B26B 21/222 30/50
8,381,406 B2 * 2/2013 Miyazaki ..... B26B 21/225 30/51
8,438,735 B2 * 5/2013 De Klerk ..... B26B 21/446 30/50
8,561,300 B2 * 10/2013 Rehbein ..... B26B 21/40 30/50
8,590,162 B2 * 11/2013 Park ..... B26B 21/225 30/50
8,671,577 B2 * 3/2014 Brown ..... B26B 21/521 30/50
8,745,877 B2 * 6/2014 Szczepanowski .. B26B 21/4018 30/51
8,991,058 B2 * 3/2015 Dimitris ..... B26B 21/225 30/50
2002/0026721 A1 3/2002 Lee et al.
2011/0252646 A1 * 10/2011 Gordon ..... B26B 21/225 30/47
2012/0124840 A1 * 5/2012 Iaccarino ..... B26B 21/225 30/50
2013/0312265 A1 * 11/2013 Wilson ..... B26B 21/40 30/51
2014/0116211 A1 * 5/2014 Griffin ..... B26B 21/521 30/47
2014/0259679 A1 * 9/2014 Tracy ..... B26B 21/225 30/50
2015/0217466 A1 * 8/2015 Leicht ..... B26B 21/521 30/50
2015/0306777 A1 * 10/2015 Georgakis ..... B26B 21/225 30/51
2016/0250764 A1 * 9/2016 Hashimoto ..... B26B 21/521 30/47
2018/0264665 A1 * 9/2018 Kim ..... B26B 21/222
2018/0264667 A1 * 9/2018 Chang ..... B26B 21/225
2018/0272549 A1 * 9/2018 Son ..... B26B 21/08
2019/0047164 A1 * 2/2019 Lee ..... B26B 21/40
2019/0099905 A1 * 4/2019 Park ..... B26B 21/225
2019/0152077 A1 * 5/2019 Kim ..... B26B 21/521
2019/0152078 A1 * 5/2019 Jang ..... B26B 21/225
2019/0152079 A1 * 5/2019 Chang ..... B26B 21/521
2019/0315006 A1 * 10/2019 Park ..... B26B 21/521
2019/0315009 A1 * 10/2019 Park ..... B26B 21/222

FOREIGN PATENT DOCUMENTS

EP 3461604 A1 * 4/2019 ..... B26B 21/225
JP 2002-526220 A 8/2002
JP 2010527736 8/2010
JP 2013-528116 A 7/2013
KR 10-1988-0004911 A 6/1988
KR 10-1988-0013665 A 12/1988
KR 10-2002-0001083 A 1/2002
KR 20020001083 1/2002
KR 10-2005-0090488 A 9/2005
KR 10-0868114 B1 11/2008
KR 10-2008-0105676 A 12/2008
KR 20080105676 12/2008
KR 10-2010-0067372 A 6/2010
WO 0016951 3/2000
WO 2008147133 12/2008
WO 2014051842 4/2014

OTHER PUBLICATIONS

Japan Patent Office Application No. 2018526130, Office Action dated May 28, 2019, 2 pages.
International Search Report issued for corresponding International Patent Application No. PCT/KR2015/012534, dated Aug. 19, 2016, with an English translation.
European Patent Office Application Serial No. 15908860.8, Search Report dated Jul. 26, 2019, 5 pages.

* cited by examiner

RAZOR

CROSS REFERENCE TO RELATED APPLICATIONS

This application is a continuation application of international application PCT/KR2015/012534, filed on Nov. 20, 2015, now pending, which claims foreign priority from Korean Patent Application No. 10-2015-0163126 filed on Nov. 20, 2015 in the Korean Intellectual Property Office, the disclosure of each document is incorporated herein by reference in their entirety.

FIELD

The present disclosure relates to a razor, and more particularly, to a razor in which a handle assembly can be smoothly attached to or detached from a razor cartridge through the improvement of the connecting structure between the handle assembly and the razor cartridge.

BACKGROUND

Generally, a razor is designed to shave body hair such as fine hairs of the face, beards, and sideburns. The razor consists of a handle assembly for gripping and a razor cartridge having a razor blade for performing shaving in contact with the skin. Such razors are divided into a replaceable type in which the handle assembly and the razor cartridge are separable and an integrated type in which the handle assembly and the razor cartridge are fixed to each other.

In the case of a separable type razor in which the handle assembly and the razor cartridge are separable, a holder provided on an upper side of the handle assembly is connected to a holder mounting part when it is inserted into a space formed by a connector and the holder mounting part of the razor cartridge. In addition, the holder of the handle assembly is separated from the holder mounting part when an operation button provided in the handle assembly is pushed toward the razor cartridge.

In a conventional razor, the connector and the holder mounting part are integrally formed on a cartridge main body of the razor cartridge. Therefore, even if an external force is applied to the razor cartridge, there is almost no deformation of the connector and the holder mounting part. Accordingly, the engagement force between the razor cartridge and the handle assembly in the conventional razor is strong. However, due to the strong engagement force between the razor cartridge and the handle assembly, when impact is applied to the razor, the razor cartridge and the handle assembly are not separated, but the connector of the razor cartridge is damaged by the impact.

In addition, the strong engagement force between the razor cartridge and the handle assembly in the conventional razor makes it difficult to separate the razor cartridge from the handle assembly.

CITATION LIST

Patent Literature

Korean Patent Publication No. 2010-0067372 (published on Jun. 21, 2010)

Aspects of the present disclosure provide a razor in which a handle assembly can be smoothly attached to or detached from a razor cartridge through the improvement of the connecting structure between the handle assembly and the razor cartridge.

However, aspects of the present disclosure are not restricted to the one set forth herein. The above and other aspects of the present disclosure will become more apparent to one of ordinary skill in the art to which the present disclosure pertains by referencing the detailed description of the present disclosure given below.

SUMMARY

According to an aspect of the present disclosure, there is provided a razor including: a cartridge main body, a front of the cartridge main body and a rear of the cartridge main body are partially open; a connector mounting part which includes a first connecting part integrally formed on the rear of the cartridge main body and a second connecting part integrally formed on the rear of the cartridge main body and spaced apart from the first connecting part; a holder mounting part which is integrally formed on the rear of the cartridge main body and is positioned between the first connecting part and the second connecting part; a handle assembly which includes a handle body held by a user and a holder pivotally positioned on an upper side of the handle body and detachably connected to the holder mounting part; and a connector which is connected to the first connecting part and the second connecting part to cover at least a part of the holder connected to the holder mounting part.

The connector may include: a base part; a first sidewall part which extends forward from one side of the base part; a second sidewall part which extends forward from the other side of the base part; a first connecting protrusion which protrudes from the first sidewall part toward one side; and a second connecting protrusion which protrudes from the second sidewall part toward the other side, and wherein the first connecting part may have a first connecting groove into which the first connecting protrusion is inserted, and the second connecting part may have a second connecting groove into which the second connecting protrusion is inserted.

The connector may further include a first hook which extends forward from an upper side of the base part; a first extension part which extends downward from a lower side of the first sidewall part; a second extension part which extends downward from a lower side of the second sidewall part; a first support protrusion which protrudes from the first extension part toward one side and supports a lower side of the first connecting part; and a second support protrusion which protrudes from the second extension part toward the other side and supports a lower side of the second connecting part, and wherein the connector mounting part may include a second hook which is integrally formed on the rear of the cartridge main body and is connected to the first hook.

The second hook may be positioned between the first connecting part and the second connecting part.

The first connecting part may include a first upper support part which extends rearward from the rear of the cartridge main body; a first lower support part which extends rearward from the rear of the cartridge main body and is located below the first upper support part; a first connection part which connects a rear side of the first upper support part with a rear side of the first lower support part and a first tapered surface which slopes from a rear side of the first connection part toward the first connecting groove, and wherein the second connecting part may include a second upper support part which extends rearward from the rear of the cartridge main body; a second lower support part which extends rearward from the rear of the cartridge main body and is disposed below the second upper support part to be spaced apart from the second upper support part; a second connection part which connects a rear side of the second upper support part with a rear side of the second lower support part; and a second tapered surface which slopes from a rear side of the second connection part toward the second connecting groove.

The connector may further include an upper sidewall part which extends forward from an upper side of the base part; and one or more locking protrusions which protrude forward from a front side of the upper sidewall part, wherein the connector mounting part may further include a locking projection which protrudes rearward from the rear of the cartridge main body and supports upper sides of the locking protrusions.

The upper sidewall part may include one or more insertion grooves at the front side of the upper sidewall part, and the connector mounting part may include insertion protrusions which protrude rearward from the rear of the cartridge main body and are inserted into the one or more insertion grooves.

The holder mounting part may include an attaching/detaching protrusion which extends rearward from the rear of the cartridge main body; a first connecting projection which extends upward from one side of the attaching/detaching protrusion; and a second connecting projection which extends upward from the other side of the attaching/detaching protrusion, and wherein the holder may include a seating groove in which the attaching/detaching protrusion is seated; a first attaching/detaching hook part which is formed to correspond to the first connecting projection and is detachably connected to the first connecting projection; and a second attaching/detaching hook part which is formed to correspond to the second connecting projection and is detachably connected to the second connecting projection.

The attaching/detaching protrusion may be formed on a lower middle portion of the rear of the cartridge main body.

The first sidewall part and the second sidewall part may be made of an elastic material.

Other specific aspects of the present disclosure are included in the detailed description and the drawings.

A razor according to the present disclosure provides at least one of the following advantages.

Since the connecting structure between a handle assembly and a razor cartridge is improved, the handle assembly can be smoothly attached to or detached from the razor cartridge.

In addition, since a connector is separated from a cartridge main body when more than a certain level of external impact is applied to the razor cartridge, the connector can be prevented from being damaged.

However, the effects of the present disclosure are not restricted to the one set forth herein. The above and other effects of the present disclosure will become more apparent to one of daily skill in the art to which the present disclosure pertains by referencing the claims.

BRIEF DESCRIPTION OF THE DRAWING

While the specification concludes with claims particularly pointing out and distinctly claiming the subject matter is regarded as forming the present disclosure, it is believed that the disclosure will be better understood from the following description taken in conjunction with the accompanying drawings.

DETAILED DESCRIPTION

Figure 1:
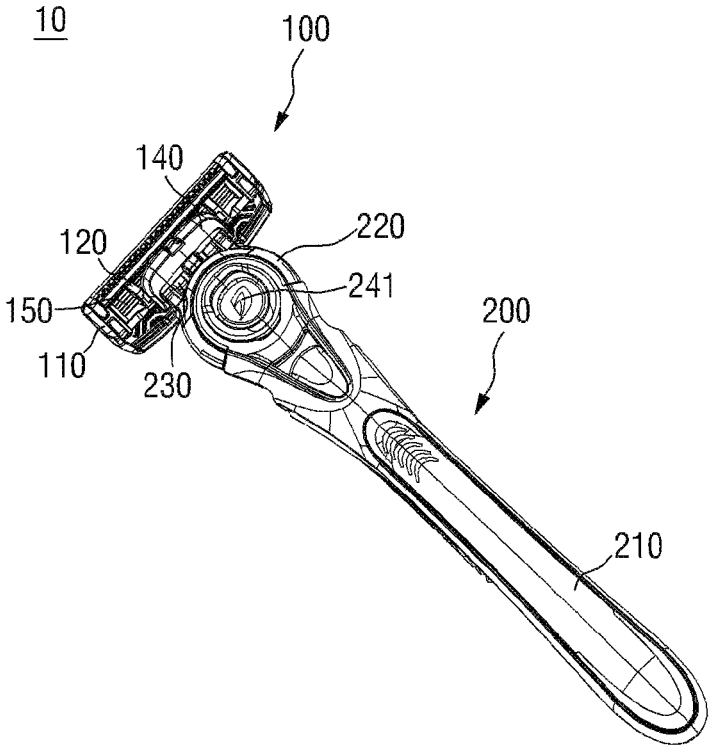
FIG. 1 is a perspective view of a razor according to an embodiment of the present disclosure.

Advantages and features of the present disclosure and methods of accomplishing the same may be understood more readily by reference to the following detailed description of exemplary embodiments and the accompanying drawings. The present disclosure may, however, be embodied in many different forms and should not be construed as being limited to the embodiments set forth herein. Rather, these embodiments are provided so that this disclosure will be thorough and complete and will fully convey the concept of the present disclosure to those skilled in the art, and the present disclosure will only be defined by the appended claims. Like reference numerals refer to like elements throughout the specification.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated components, steps, operations, and/or elements, but do not preclude the presence or addition of one or more other components, steps, operations, elements, and/or groups thereof.

Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Hereinafter, the present disclosure will be described with reference to the drawings for explaining a razor according to embodiments of the present disclosure.

Figure 2:
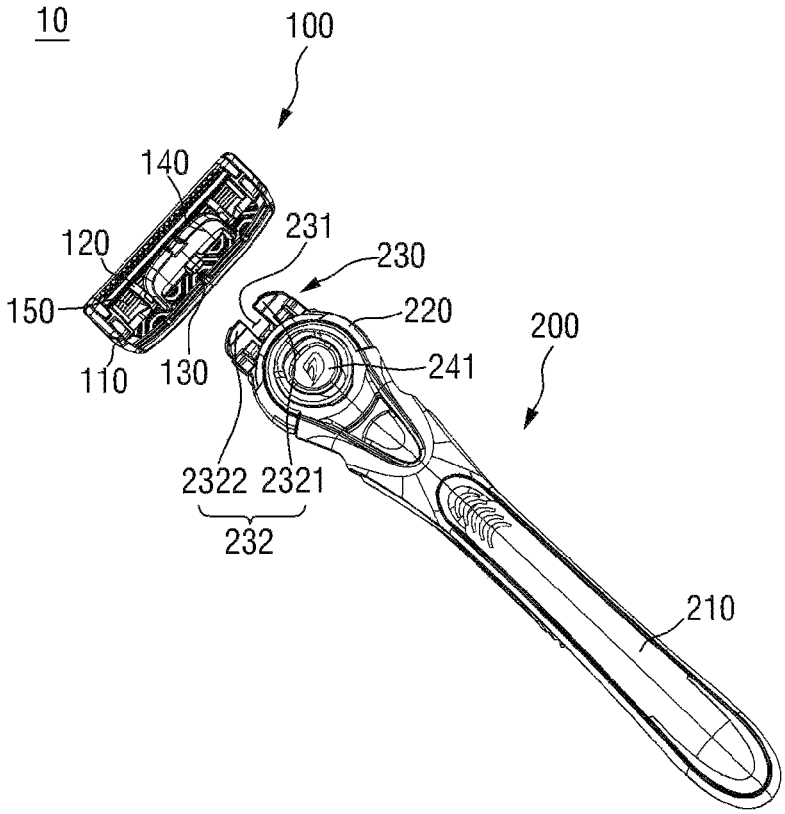
FIG. 2 is a perspective view showing a state in which a razor cartridge and a handle assembly are separated from each other in the razor of FIG. 1.

FIG. 1 is a perspective view of a razor according to an embodiment of the present disclosure. FIG. 2 is a perspective view showing a state in which a razor cartridge and a handle assembly are separated from each other in the razor of FIG. 1.

Referring to FIGS. 1 and 2, a razor 10 according to the embodiment of the present disclosure includes a razor cartridge 100 having a plurality of razor blades 150 for cutting hair on the skin and a handle assembly 200 serving as a handle to be held by a user.

The razor cartridge 100 is detachably connected to a holder 230 provided on an upper side of the handle assembly 200. Therefore, when the life of the razor blades 150 included in the razor cartridge 100 ends, the razor 10 can still be used by replacing only the razor cartridge 100 instead of purchasing a new razor.

In addition, the razor cartridge 100 is pivotally connected to the upper side of the handle assembly 200. When the razor cartridge 100 pivots on the handle assembly 200, the adhesion of the razor 10 to the skin is increased as compared to when the razor cartridge 100 is fixed to the handle assembly 200. Accordingly, the degree of irritation to the skin may be reduced, thereby improving the shaving performance of the razor 10.

The razor cartridge 100 includes a cartridge main body 110, a connector mounting part 120, a holder mounting part 130, the blades 150, and a connector 140.

As shown in FIGS. 1 and 2, the cartridge main body 110 may have a rectangular shape that is long on both sides, and corners of the cartridge main body 110 may be curved to reduce irritation to the skin.

In addition, the front and rear of the cartridge main body 110 are partially open. Accordingly, the beard or the like cut by the blades 150 during shaving can be smoothly discharged to the outside through upper and lower surfaces of the open cartridge main body 110.

A razor blade installation part (not shown) in which one or more razor blades 150 are installed is provided at the front of the cartridge main body 110. The razor blade installation part includes installation grooves (not shown), into which both sides of each of the razor blades in a width direction are respectively inserted, and at least one blade support part (no reference numeral) which supports a part of a rear side of each of the razor blades. In addition, each of the installation grooves has a recessed depth to allow only a front area of each of the razor blades, where a cutting edge is formed, to protrude from a front side of the installation groove. The support part is positioned between the installation grooves, into which both sides of each of the razor blades are respectively inserted, and supports the rear side of each of the razor blades.

When the razor blades are installed in the razor blade installation part of the cartridge main body 110, clips (no reference numeral) respectively cover both sides of each of the razor blades. Accordingly, the razor blades are fixed to the front of the cartridge main body 110.

The connector mounting part 120 to which the connector 140 is connected is integrally formed on the rear of the cartridge main body 110. In addition, the holder mounting part 130, to which the holder 230 is detachably connected, is integrally formed on the rear of the cartridge main body 110. Therefore, the connector mounting part 120 and the holder mounting part 130 are integrally formed on the rear of the cartridge main body 110. This will be described in detail later.

One or more razor blades 150 are installed at the front of the cartridge main body 110. As shown in FIGS. 1 and 2, five blades 150 may be installed at the front of the cartridge main body 110. Therefore, since the plurality of razor blades 150 sequentially pass over the hair during shaving, a cutting force for the hair can be improved.

The connector 140 is connected to the connector mounting part 120 formed on the rear of the cartridge main body 110. Depending on embodiments, the connector 140 may be connected to the connector mounting part 120 by, but not limited to, an interference fit or a transition fit.

The connector 140 is connected to the connector mounting part 120 to form a space in which the holder 230 is mounted. This will be described in detail later.

The handle assembly 200 includes a handle body 210 which is held by a user, a housing 220 which is installed on an upper side of the handle body 210, and the holder 230 which is pivotally installed on an upper side of the housing 220 and detachably connected to the holder mounting part 130. This will be described in detail later.

Figure 3:
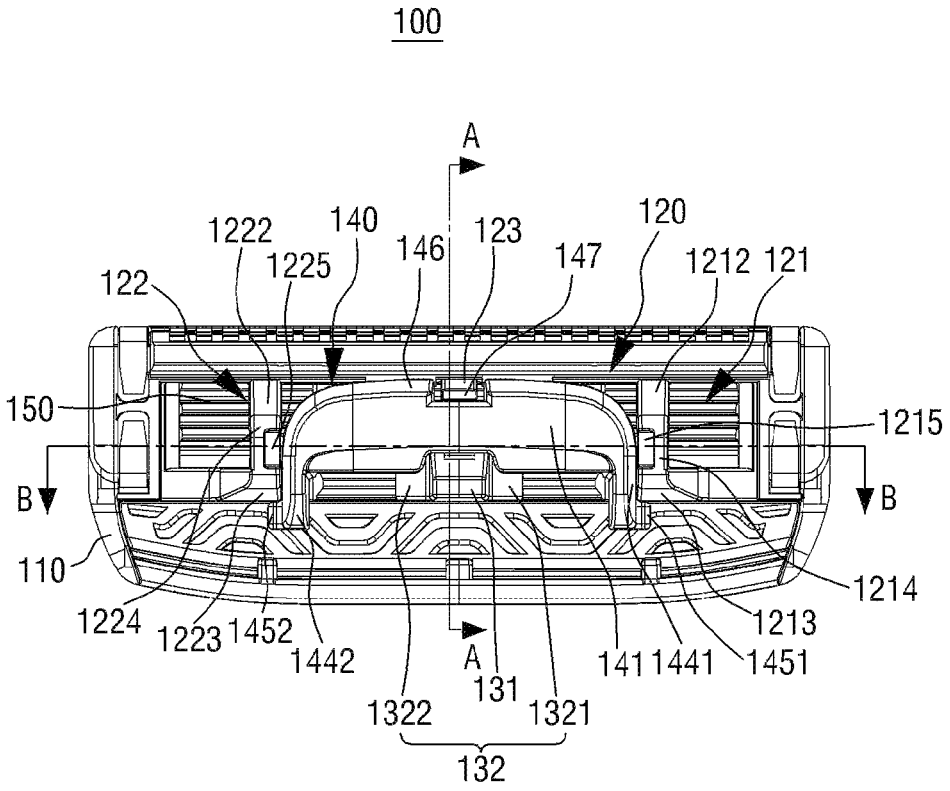
FIG. 3 is a rear plan view of the razor cartridge according to the embodiment of the present disclosure.
Figure 4:
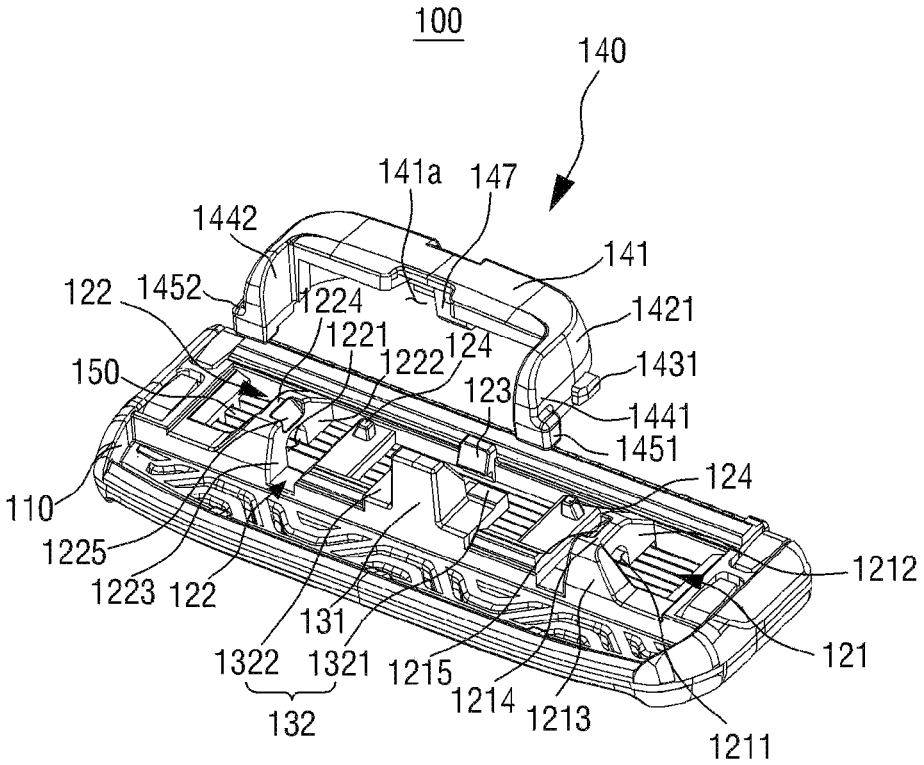
FIG. 4 is a perspective view showing a state in which a cartridge main body and a connector are separated from each other in the razor cartridge of FIG. 3.

FIG. 3 is a rear plan view of the razor cartridge according to the embodiment of the present disclosure. FIG. 4 is a perspective view showing a state in which the cartridge main body and the connector are separated from each other in the razor cartridge of FIG. 3.

Referring to FIGS. 3 and 4, the connector mounting part 120 and the holder mounting part 130 are formed on the rear of the cartridge main body 110, as described above. The connector mounting part 120 and the holder mounting part 130 may be integrally formed with the cartridge main body 110. As the connector 140 is connected to the connector mounting part 120, a receiving space for receiving at least a part of the holder 230 connected to the holder mounting part 130 is formed. In other words, as the connector 140 is connected to the connector mounting part 120, covers at least a part of the holder 230 connected to the holder mounting part 130.

Therefore, unlike in a conventional razor in which a holder mounting part is integrally formed in a connector, the holder mounting part 130 is not formed in the connector 140 but is formed on the rear of the cartridge main body 110 in the razor 10 (see FIG. 1) according to the embodiment of the present disclosure. In other words, the holder mounting part 130 is separated from the connector 140.

A conventional razor includes a razor cartridge which includes a cartridge main body and a connector and a handle assembly which includes a handle body and a holder. The connector may be integrally formed or connected to the cartridge main body and have a holder mounting part to which the holder of the handle assembly is detachably connected.

When a certain level of external impact is applied to the conventional razor due to the falling of the razor on the floor or the like, the connector is often easily damaged by absorbing external impact applied to the holder.

However, in the razor 10 according to the embodiment of the present disclosure, the holder mounting part 130 and the connector 140 are separated from each other. Therefore, even if external impact within a certain range is applied to the razor cartridge 100, the connector 140 can be deformed independently of the cartridge main body 110 and absorb the external impact. Hence, the razor 10 according to the embodiment of the present disclosure is less likely to be damaged by external impact than the conventional razor in which the connector and the cartridge main body are integrally formed. In addition, since the connector 140 can be detached from the cartridge main body 110 when more than a certain level of external impact is applied, the razor 10 according to the embodiment of the present disclosure is less likely to be damaged by the external impact than the conventional razor in which the connector and the cartridge main body are integrally formed.

In addition, when the connector 140 is connected to the connector mounting part 120, the receiving space for receiving the holder 230 provided on the upper side of the handle assembly 200 is formed as described above. In addition, the holder mounting part 130, to which the holder 230 is detachably connected, is located approximately in the middle of the receiving space formed by the connector 140 and the connector mounting part 120.

The connector 140, the connector mounting part 120, and the holder mounting part 130 of the razor cartridge 100 will be described later.

Figure 5:
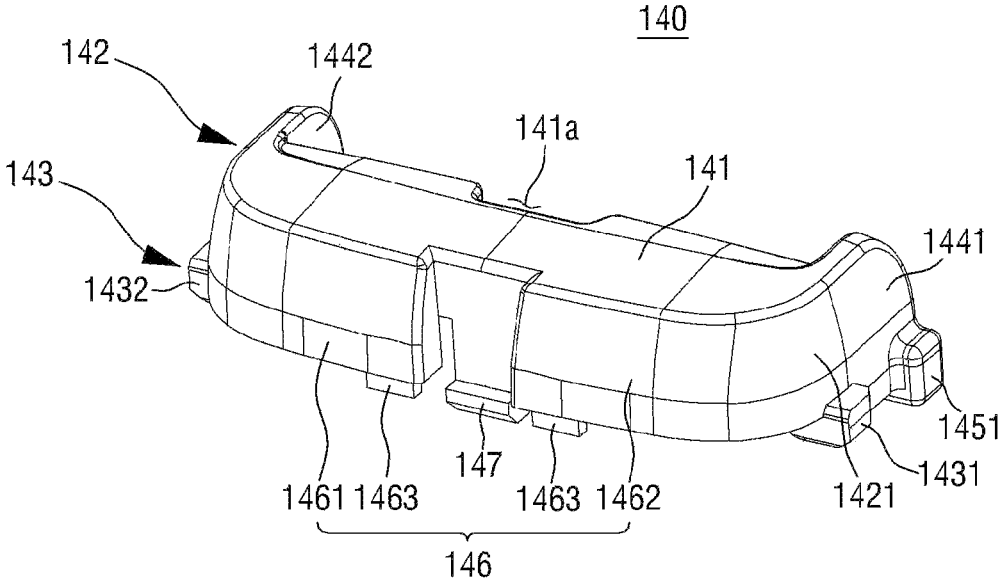
FIG. 5 is a perspective view of the connector of the razor cartridge according to the embodiment of the present disclosure viewed from above.
Figure 6:
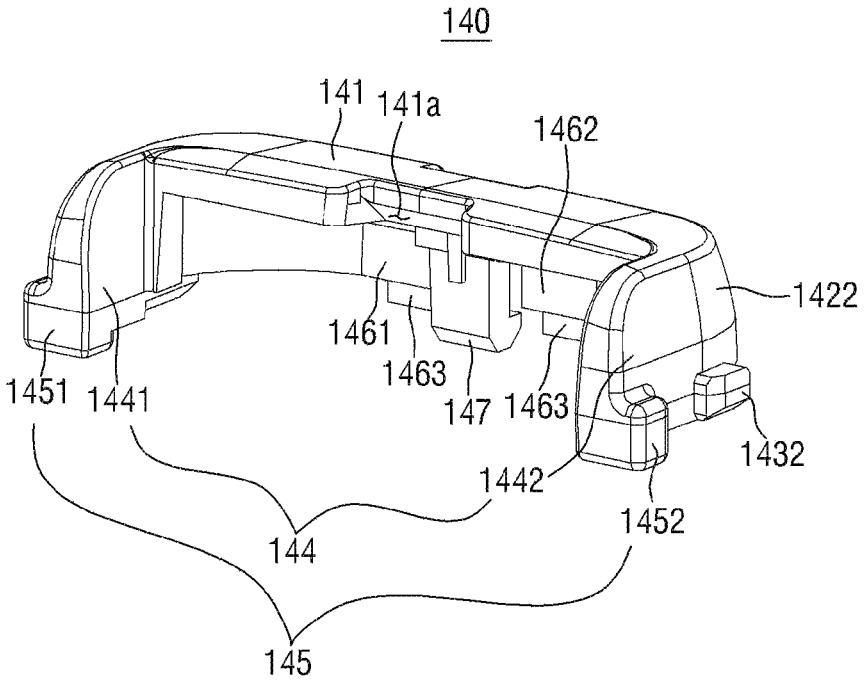
FIG. 6 is a perspective view of the connector of the razor cartridge according to the embodiment of the present disclosure viewed from below.
Figure 7:
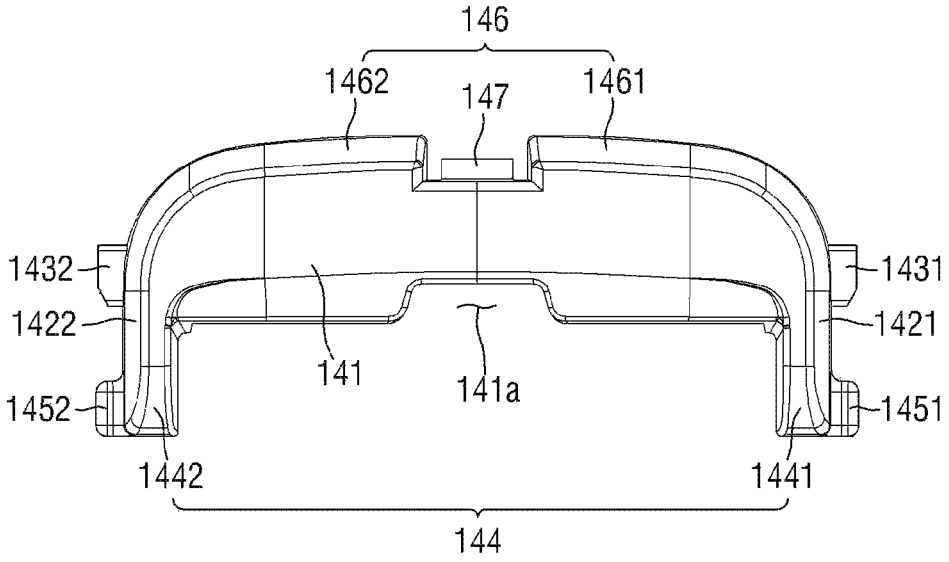
FIG. 7 is a plan view of the connector of the razor cartridge according to the embodiment of the present disclosure.
Figure 8:
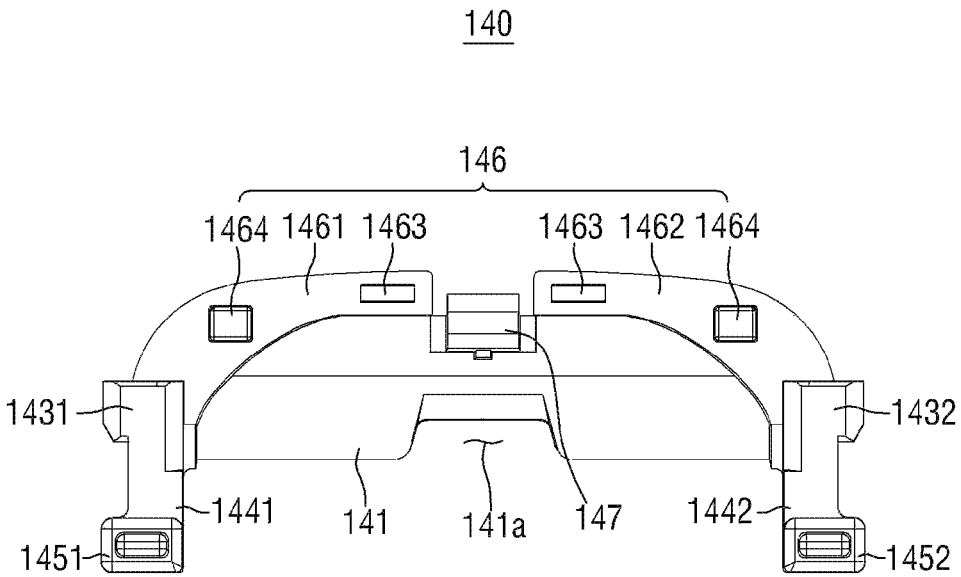
FIG. 8 is a rear view of the connector of the razor cartridge according to the embodiment of the present disclosure.

FIG. 5 is a perspective view of the connector of the razor cartridge according to the embodiment of the present disclosure viewed from above. FIG. 6 is a perspective view of the connector of the razor cartridge according to the embodiment of the present disclosure viewed from below. FIG. 7 is a plan view of the connector of the razor cartridge according to the embodiment of the present disclosure. FIG. 8 is a rear view of the connector of the razor cartridge according to the embodiment of the present disclosure.

Referring to FIGS. 5 through 8, the connector 140 according to the embodiment of the present disclosure includes a base part 141, both-side sidewall parts 142, an upper sidewall part 146, extension parts 144, a first hook 147, connecting protrusions 143, and support protrusions 145.

The base part 141 is disposed to face the connector mounting part 120 formed on the rear of the cartridge main body. Accordingly, the base part 141 is spaced apart from the connector mounting part 120 located ahead.

Referring to FIG. 6, the base part 141 has a substantially rectangular shape. In addition, corners of the base part 141 are rounded. Furthermore, a concave groove 141*a* is formed at a middle portion of one side of the base part 141. This is to minimize the interference between the base part 141 and an attaching/detaching protrusion 131 of the holder mounting part 130 which will be described later.

In addition, referring to FIG. 8, the internal shape of the connector 140 formed by the base part 141, the both-side sidewall parts 142 and the upper sidewall part 146 corresponds to the external shape of the holder 230. Accordingly, the shape of the receiving space formed by the connector 140 and the connector mounting part 120 may correspond to the shape of the holder 230.

The first hook 147 extends from another side of the base part 141 toward the connector mounting part 120. In other words, the first hook 147 extends forward from the other side of the base part 141.

Referring to FIG. 5, the first hook 147 extends forward from a middle portion at another side of the base part 141. In addition, the first hook 147 is hooked to a second hook 123 of the connector mounting part 120 which will be described later. In addition, the first hook 147 and the second hook 123 may be made of an elastic material. Accordingly, the first hook 147 and the second hook 123 can be elastically moved by an external force applied to the connector 140.

The upper sidewall part 146 extends from the other side of the base part 141 toward the connector mounting part 120. In other words, the upper sidewall part 146 extends forward from the other side of the base part 141. Therefore, the first hook 147 and the upper sidewall part 146 extend forward from the other side of the base part 141.

Referring to FIG. 5, a part of the upper sidewall part 146 which corresponds to the first hook 147 is open. Accordingly, the upper sidewall part 146 includes a first upper sidewall part 1461 located on one side of the first hook 147 and a second upper sidewall part 1462 located on the other side of the first hook 147.

Referring to FIG. 7, the first upper sidewall part 1461 and the second upper sidewall part 1462 are formed symmetrically with respect to the first hook 147. In addition, the upper sidewall part 146 may be made of an elastic material that can be compressed and/or stretched by an external force.

Referring to FIG. 8, the upper sidewall part 146 includes one or more insertion grooves 1464 at its front side. Insertion protrusions 124 of the connector mounting part 120 which will be described later are inserted into the insertion grooves 1464 to enhance the connecting between the connector 140 and the connector mounting part 120.

Referring to FIG. 8, the insertion grooves 1464 are formed at front sides of the first and second upper sidewall parts 1461 and 1462, respectively. In addition, the insertion grooves 1464 are formed symmetrically with respect to the first hook 147.

In addition, one or more locking protrusions 1463 are formed at the front side of the upper sidewall part 146. The locking protrusions 1463 protrude forward from the front side of the upper sidewall part 146.

Referring FIGS. 6 and 8, the locking protrusions 1463 are respectively formed at the front sides of the first and second upper sidewall parts 1461 and 1462 and are positioned adjacent to the first hook 147. In addition, the locking protrusions 1463 are formed symmetrically with respect to the first hook 147. The locking protrusions 1463 catch on a locking projection 125 (see FIG. 9) of the connector mounting part 120 to be described later, thereby restricting the upward movement of the connector 140.

Referring to FIG. 5, the both-side sidewall parts 142 extend from both sides of the base part 141 toward the connector mounting part 120. Here, the both sides may be defined as left and right sides.

Referring to FIG. 7, the both-side sidewall parts 142 include a first sidewall part 1421 extending forward from one side of the base part 141 and a second sidewall part 1422 extending forward from the other side of the base part 141. In addition, the first sidewall part 1421 and the second sidewall part 1422 are formed symmetrically with respect to the first hook 147. Here, the one side refers to, but is not limited to, the right side, and the other side refers to, but is not limited to, the left side.

The first and second sidewall parts 1421 and 1422 extend substantially perpendicular to the base part 141. In addition, the connecting protrusions 143 are formed on the first and second sidewall parts 1421 and 1422, respectively.

In addition, the first and second sidewall parts 1421 and 1422 may be made of an elastic material that can be compressed and/or stretched by an external force.

The connecting protrusions 143 protrude from the both-side sidewall part 142 toward both sides. The connecting protrusions 143 are respectively inserted into connecting grooves 1211 and 1221 of the connector mounting part 120 to be described later, so that the connector 140 is connected to the connector mounting part 120. As shown in FIG. 7, since the connecting protrusions 143 protrude to both sides from the both-side sidewall parts 142, they are provided as a pair. Accordingly, the connecting protrusions 143 include a first connecting protrusion 1431 protruding from the first sidewall part 1421 toward one side and a second connecting protrusion 1432 protruding from the second sidewall part 1422 toward the other side.

The first connecting protrusion 1431 is formed at a lower side of the first sidewall part 1421 and inserted into the first connecting groove 1211 of the connector mounting part 120 which will be described later. In addition, the second connecting protrusion 1432 is formed at a lower side of the second sidewall part 1422 and inserted into the second connecting groove 1221 of the connector mounting part 120 which will be described later.

The extension parts 144 extend downward from lower sides of the both-side sidewall parts 142. Accordingly, the extension parts 144 include a first extension part 1441 extending downward from a lower side of the first sidewall part 1421 and a second extension part 1442 extending downward from a lower side of the second sidewall part 1422. The first extension part 1441 and the second extension part 1442 are formed symmetrically with respect to the first hook 147.

In addition, at least a part of the first extension part 1441 is located lower than a first connecting part 121 of the connector mounting part 120 which will be described later. In addition, at least a part of the second extension part 1442 is located lower than a second connecting part 122 of the connector mounting part 120 which will be described later.

The support protrusions 145 protrude outward from lower sides of the extension parts 144 and support lower sides of the first and second connecting parts 121 and 122 of the connector mounting part 120 which will be described later.

Referring to FIG. 7, the support protrusions 145 include a first support protrusion 1451 protruding from a lower side of the first extension part 1441 toward one side and a second support protrusion 1452 protruding from a lower side of the second extension part 1442 to the other side.

The support protrusions 145 are disposed lower than the connecting protrusions 143 and spaced apart from the connecting protrusions 143. Accordingly, spaces in which lower support parts 1213 and 1223 of the connecting parts 121 and 122 to be described later are located are formed between the support protrusions 145 and the connecting protrusions 143, respectively.

In addition, the spaces between the support protrusions 145 and the connecting protrusions 143 may be formed larger than the lower support parts 1213 and 1223 so that the connector 140 can move slightly. For example, distances between the support protrusions 145 and the protruding protrusions 143 may be larger than vertical widths of the lower support parts 1213 and 1223, respectively.

Figure 9:
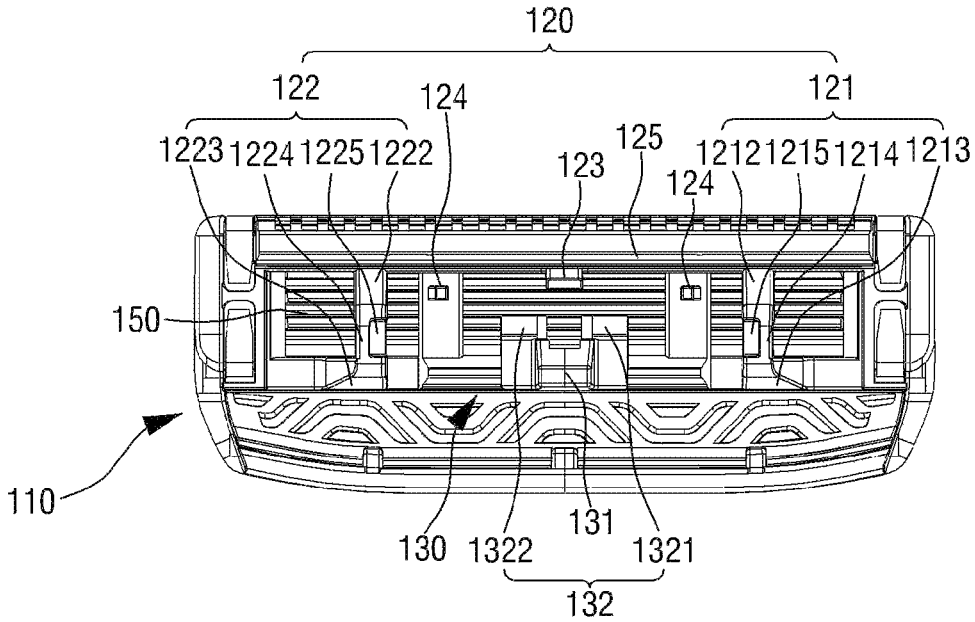
FIG. 9 is a rear plan view of the razor cartridge from which the connector according to the embodiment of the present disclosure has been detached.
Figure 10:
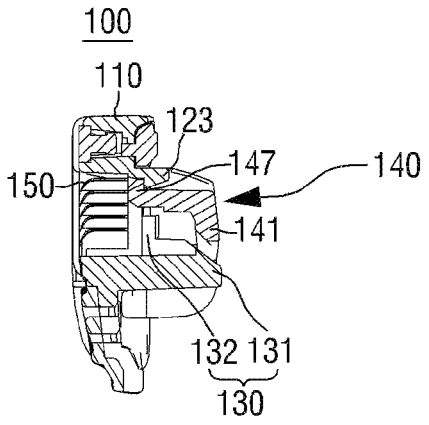
FIG. 10 is a cross-sectional view taken along the line A-A of FIG. 3.
Figure 11:
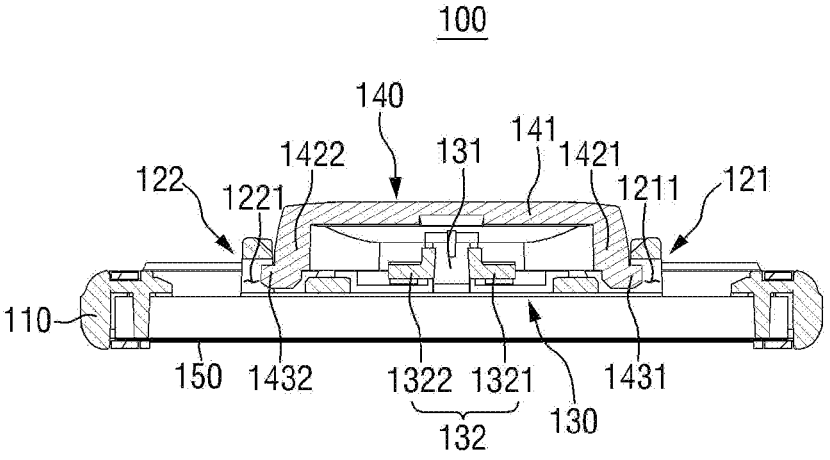
FIG. 11 is a cross-sectional view taken along the line B-B of FIG. 3.

FIG. 9 is a rear plan view of the razor cartridge from which the connector according to the embodiment of the present disclosure has been detached. FIG. 10 is a cross-sectional view taken along the line A-A of FIG. 3. FIG. 11 is a cross-sectional view taken along the line B-B of FIG. 3.

Referring to FIGS. 9 through 11, the connector mounting part 120 is formed on the rear of the cartridge main body 110. The connector mounting part 120 includes a pair of connecting parts 121 and 122 extending rearward from the rear of the cartridge main body 110.

The pair of connecting parts 121 and 122 includes the first connecting part 121 which is integrally formed on the rear of the cartridge main body 110 and the second connecting part 122 which is integrally formed on the rear of the cartridge main body 110 and spaced apart from the first connecting part 121. The first and second connecting parts 121 and 122 are formed symmetrically with respect to a middle portion of the cartridge main body 110.

In addition, the first connecting groove 1211 into which the first connecting protrusion 1431 of the connector 140 is inserted is formed in the first connecting part 121. In addition, the second connecting groove 1221 into which the second connecting protrusion 1432 of the connector is inserted is formed in the second connecting part 122.

As shown in FIGS. 9 and 11, the first connecting part 121 is located on one side of the middle portion of the cartridge main body 110, and the second connecting part 122 is located on the other side of the middle portion of the cartridge main body 110. In the embodiment of the present disclosure, the one side refers to, but is not limited to, the right side, and the other side refers to, but is not limited to, the left side.

Referring to FIG. 4, each of the first and second connecting grooves 1211 and 1221 is, but is not limited to, substantially U-shaped with an open front side. In addition, the first and second connecting grooves 1211 and 1221 are formed larger than the first and second connecting protrusions 1431 and 1432. For example, the sizes of the first and second connecting grooves 1211 and 1221 may be within a tolerance range that allows the first and second connecting protrusions 1431 and 1432 to be clearance-fitted into the first and second connecting grooves 1211 and 1221.

Accordingly, since a little space is formed between each of the connecting grooves 1211 and 1221 and each of the connecting protrusions 1431 and 1432, the connector 140 can be moved slightly by an external force. However, the connector 140 is moved slightly only within the space between each of the connecting grooves 1211 and 1221 and each of the connecting protrusions 1431 and 1432.

For example, in order to separate the holder 230 from the holder mounting part 130, a user pushes the connector 140 upward using a push button 241 (see FIG. 13) which will be described later. In other words, the user applies the external force to the connector 140 through the push button 241.

Since the connecting grooves 1211 and 1221 are formed larger than the connecting protrusions 1431 and 1432, the external force applied to the connector 140 can move the connector 140 slightly. Therefore, the receiving space in which the holder 230 is received is increased, although slightly, and the holder 230 can be easily separated from the holder mounting part 130.

On the other hand, in a conventional razor in which a holder mounting part is formed in a connector, even if the external force is applied to the connector, a space in which a holder is received hardly changes. Therefore, a user has to forcibly separate the holder from the holder mounting part by applying a large external force to the connector. Hence, the user may feel inconvenience when separating the holder from the holder mounting part.

In addition, the first connecting part 121 includes a first upper support part 1212 which extends rearward from the rear of the cartridge main body 110, the first lower support part 1213 which extends rearward from the rear of the cartridge main body 110 and is disposed below the first upper support part 1212 to be spaced apart from the first upper support part 1212, and a first connection part 1214 which connects a rear side of the first upper support part 1212 and a rear side of the first lower support part 1213.

Therefore, a space is formed between the first upper support part 1212 and the first lower support part 1213. The space formed by the first upper support part 1212 and the first lower support part 1213 is the first connecting groove 1211.

In addition, the first connecting part 121 further includes a first tapered surface 1215 sloping from a rear side of the first connecting part 1214 toward the first connecting groove 1211. When the first connecting protrusion 1431 is inserted into the first connecting groove 1211, the first tapered surface 1215 guides the movement of the first connecting protrusion 1431 toward the first connecting groove 1211. Therefore, the first connecting protrusion 1431 can be easily moved toward the first connecting groove 1211 along the first tapered surface 1215 and inserted into the first connecting groove 1211.

The second connecting part 122 includes a second upper support part 1222 which extends rearward from the rear of the cartridge main body 110, the second lower support part 1223 which extends rearward from the rear of the cartridge main body 110 and is disposed below the second upper support part 1222 to be spaced apart from the second upper support part 1222, and a second connection part 1224 which connects a rear side of the second upper support part 1222 and a rear side of the second lower support part 1223.

Therefore, a space is formed between the second upper support part 1222 and the second lower support part 1223. The space formed by the second upper support part 1222 and the second lower support part 1223 is the second connecting groove 1221.

As described above, the first lower support part 1213 is positioned in the space between the first connecting protrusion 1431 and the first support protrusion 1451. In addition, the second lower support part 1223 is positioned in the space between the second connecting protrusion 1432 and the second support protrusion 1452.

In addition, the second connecting part 122 further includes a second tapered surface 1225 sloping from a rear side of the second connection part 1224 toward the second connecting groove 1221. When the second connecting protrusion 1432 is inserted into the second connecting groove 1221, the second tapered surface 1225 guides the movement of the second connecting protrusion 1432 toward the second connecting groove 1221. Therefore, the second connecting protrusion 1432 can be easily moved toward the second connecting groove 1221 along the second tapered surface 1225 and inserted into the second connecting groove 1221.

In addition, the connector mounting part 120 further includes the second hook 123 which is integrally formed on the rear of the cartridge main body 110 and hooked to the first hook 147 of the connector 140 described above. As shown in FIG. 4, the second hook 123 protrudes rearward from an upper middle portion of the rear of the cartridge main body 110. The second hook 123 is hooked to the first hook 147 so as to increase the connecting force between the connector mounting part 120 and the connector 140.

The connector mounting part 120 includes the locking projection 125 formed at a position corresponding to the locking protrusions 1463 of the connector 140 described above. The locking projection 125 protrudes rearward from the rear of the cartridge main body 110 to prevent the upward movement of the connector 140.

In addition, the connector mounting part 120 includes the insertion protrusions 124 formed at positions corresponding to the insertion grooves 1464 of the connector 140 described above. The insertion protrusions 124 protrude rearward from the rear of the cartridge main body 110 and are inserted into the insertion grooves 1464. Accordingly, the connecting force between the connector mounting part 120 and the connector 140 is increased.

In addition, the razor cartridge 100 includes the holder mounting part 130 integrally formed on the rear of the cartridge main body 110. The holder mounting part 130 is a part to which the holder 230 of the handle assembly 200 described above is detachably connected.

In addition, the holder mounting part 130 is positioned between the first and second connecting parts 121 and 122 of the connector mounting part 120. As shown in FIG. 4, the holder mounting part 130 is formed approximately in the middle portion of the cartridge main body 110.

The holder mounting part 130 includes the attaching/detaching protrusion 131 extending rearward from the rear of the cartridge main body 110 and connecting projections 132 extending upward from both sides of the attaching/detaching protrusion 131.

In an embodiment of the present disclosure, the connecting projections 132 include a first connecting projection 1321 extending upward from one side of the attaching/detaching protrusion 131 and a second connecting projection 1322 extending upward from the other side of the attaching/detaching protrusion 131. In the embodiment of the present disclosure, the one side refers to, but is not limited to, the right side, and the other side refers to, but is not limited to, the left side.

Referring to FIG. 9, the attaching/detaching protrusion 131 extends rearward from a lower middle portion of the rear of the cartridge main body 110. Accordingly, the attaching/detaching protrusion 131 is located in the middle portion of the cartridge main body 110 together with the second hook 123 and is disposed to face the second hook 123.

Referring to FIG. 9, lower sides of attaching/detaching hook parts 232 of the holder 230, which will be described later, are supported at upper sides of the first and second connecting projections 1321 and 1322. In other words, when the holder 230 of the handle assembly 200 is inserted into the receiving space formed by the connector mounting part 120 and the connector 140, the attaching/detaching hook parts 232 of the holder 230 catch on the first and second connecting projections 1321 and 1322, respectively. Accordingly, the handle assembly 200 is connected to the razor cartridge 100.

In addition, the first and second connecting projections 1321 and 1322 are disposed symmetrically with respect to the attaching/detaching protrusion 131. When the external force is applied to the first and second connecting projections 1321 and 1322 by the holder 230 of the handle assembly 200, the first and second connecting projections 1321 and 1322 can move elastically. Therefore, the first and second connecting projections 1321 and 1322 may be made of an elastic material.

Figure 12:
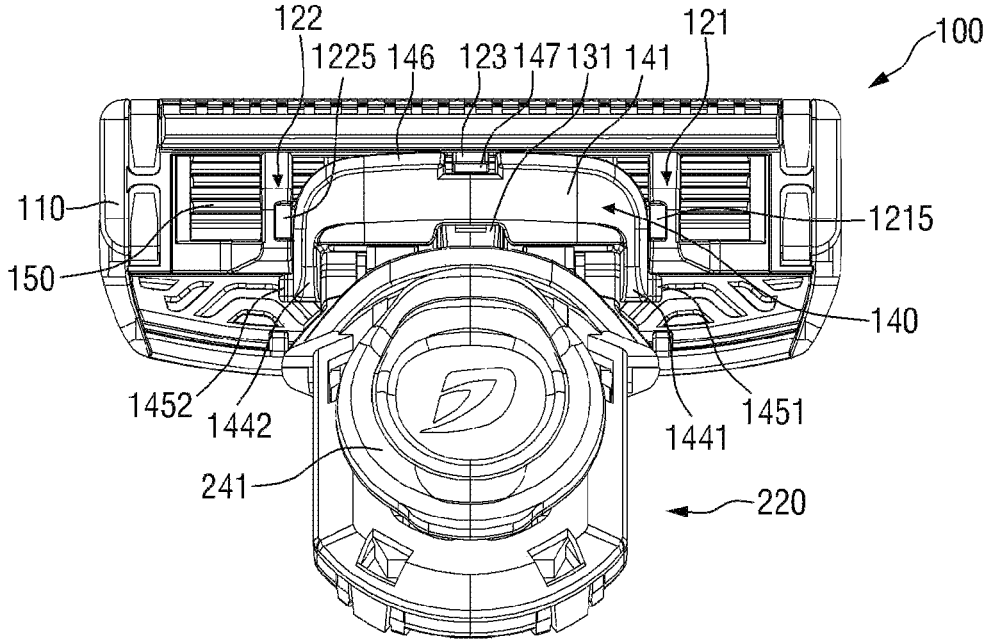
FIG. 12 is a rear plan view showing a state in which a handle body is removed from FIG. 1.
Figure 13:
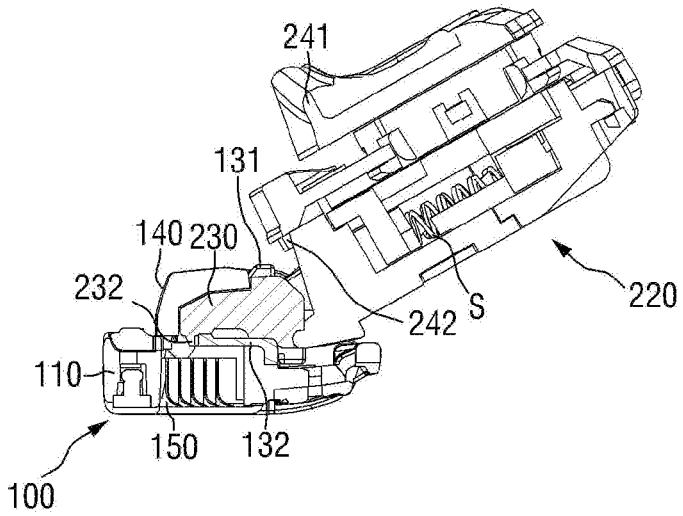
FIG. 13 is a cross-sectional view of FIG. 12.

FIG. 12 is a rear plan view showing a state in which the handle body is removed from FIG. 1. FIG. 13 is a cross-sectional view of FIG. 12.

Referring to FIG. 12, the handle assembly 200 includes the housing 220 and the holder 230.

The holder 230 is pivotally installed on the upper side of the handle body 210. The holder 230 includes a seating groove 231 in which the attaching/detaching protrusion 131 is seated. The seating groove 231 is formed in a middle portion of the holder 230.

In addition, referring to FIGS. 12 and 13, the holder 230 includes pivot axis (not shown), which protrude outward, at both sides, respectively, and the pivot axis are inserted into pivot holes (not shown) provided in the housing 220. Accordingly, the holder 230 pivots about the pivot axis. However, in an embodiment, the male and female connecting relationship between the holder 230 and the housing 220 may be changed. For example, the housing 220 may have pivot axis protruding inward, and the holder 230 may have pivot holes into which the pivot axis of the housing 220 are inserted.

In addition, the holder 230 includes the attaching/detaching hook parts 232 formed at its front side to correspond to the connecting projections 132 of the holder mounting part 130. Specifically, the attaching/detaching hook parts 232 include a first attaching/detaching hook part 2321 and a second attaching/detaching hook part 2322 formed on both sides of the seating groove 231 (see FIG. 2). The first attaching/detaching hook part 2321 is hooked to the first connecting projection 1321, and the second attaching/detaching hook part 2322 is hooked to the second connecting projection 1322. As a result, the holder 230 is detachably connected to the holder mounting part 130.

The housing 220 is connected to an upper side of the handle body 210. For example, the housing 220 includes fastening grooves (no reference numeral) into which fastening protrusions (not shown) protruding from both sides of the upper side of the handle body 210 are inserted. In addition, the housing 220 includes the push button 241 which is movably installed on the rear of the housing 220, a push protrusion 242 which is interlocked with the push button 241 to press the attaching/detaching protrusion 131 of the holder mounting part 130, and an elastic member S which provides an elastic force for returning the moved push button 241 to its original state.

Therefore, in a stat where the holder 230 is connected to the holder mounting part 130, if a user presses the push protrusion 242 against the attaching/detaching protrusion 131 by operating the push button 24 external force is applied to the razor cartridge 100 in an upward direction. Accordingly, the razor cartridge 100 may be smoothly separated from the handle assembly 200 as the holder 230 is separated from the holder mounting part 130.

While the exemplary embodiments of the present disclosure have been illustrated and described above, the present disclosure is not limited to the aforementioned specific exemplary embodiments, and various modifications may be made by those of ordinary skill in the art to which the present disclosure pertains without departing from the subject matters of the present disclosure that are claimed in the claims. Such modifications should not be appreciated individually from the technical spirit or prospect of the present disclosure.

A razor according to an embodiment of the present disclosure includes a cartridge main body, the front and rear of which are partially open; a connector mounting part which includes a first connecting part integrally formed on the rear of the cartridge main body and a second connecting part integrally formed on the rear of the cartridge main body and spaced apart from the first connecting part; a holder mounting part which is integrally formed on the rear of the cartridge main body and is positioned between the first and second connecting parts; a handle assembly which includes a handle body held by a user and a holder pivotally positioned on an upper side of the handle body and detachably connected to the holder mounting part; and a connector which is connected to the first and second connecting parts to cover at least a part of the holder connected to the holder mounting part.

What is claimed is:

1. A razor comprising:

a cartridge main body, wherein a front of the cartridge main body and a rear of the cartridge main body are partially open;

a first connecting part integrally formed on the rear of the cartridge main body;

a second connecting part integrally formed on the rear of the cartridge main body and spaced apart from the first connecting part;

a holder mounting part integrally formed on the rear of the cartridge main body and positioned between the first connecting part and the second connecting part;

a handle assembly which comprises a handle body configured to be held by a user and a holder pivotally positioned on one side of the handle body and detachably connected to the holder mounting part; and a connector connected to the first connecting part and the second connecting part and configured to engage with at least a part of the holder connected to the holder mounting part.

2. The razor of claim 1, wherein the holder mounting part comprises:

an attaching/detaching protrusion which extends rearward from the rear of the cartridge main body;

a first connecting projection which extends from one side of the attaching/detaching protrusion; and a second connecting projection which extends from another side of the attaching/detaching protrusion, and wherein the holder comprises:

a seating groove in which the attaching/detaching protrusion is seated;

a first attaching/detaching hook part which is formed to correspond to the first connecting projection and is detachably connected to the first connecting projection; and a second attaching/detaching hook part which is formed to correspond to the second connecting projection and is detachably connected to the second connecting projection.

3. The razor of claim 2, wherein the attaching/detaching protrusion is formed on a middle portion of the rear of the cartridge main body.

4. The razor of claim 1, wherein the connector comprises:

a base part;

a first sidewall part which extends forward from one side of the base part;

a second sidewall part which extends forward from another side of the base part;

a first connecting protrusion which protrudes from the first sidewall part; and a second connecting protrusion which protrudes from the second sidewall part, and wherein the first connecting part has a first connecting groove into which the first connecting protrusion is inserted, and the second connecting part has a second connecting groove into which the second connecting protrusion is inserted.

5. The razor of claim 4, wherein the first sidewall part and the second sidewall part are made of an elastic material.

6. The razor of claim 4, wherein the first connecting part comprises:

a first support part which is formed at one side of the first connecting part and extends rearward from the rear of the cartridge main body;

a second support part which is formed at another side of the first connecting part and extends rearward from the rear of the cartridge main body;

a first connection part which connects a rear side of the first support part with a rear side of the second support part; and a first tapered surface which slopes from a rear side of the first connection part toward the first connecting groove, and wherein the second connecting part comprises:

a third support part which is formed at one side of the second connecting part and extends rearward from the rear of the cartridge main body;

a fourth support part which is formed at another side of the second connecting part, extends rearward from the rear of the cartridge main body, and is spaced apart from the third support part;

a second connection part which connects a rear side of the third support part with a rear side of the fourth support part; and a second tapered surface which slopes from a rear side of the second connection part toward the second connecting groove.

7. The razor of claim 4, wherein the connector further comprises:

a first hook which extends forward from one side of the base part;

a first extension part which extends from one side of the first sidewall part;

a second extension part which extends from one side of the second sidewall part;

a first support protrusion which protrudes from the first extension part and supports one side of the first connecting part; and a second support protrusion which protrudes from the second extension part and supports one side of the second connecting part, and wherein a second hook, which is integrally formed on the rear of the cartridge main body, is connected to the first hook.

8. The razor of claim 7, wherein the second hook is positioned between the first connecting part and the second connecting part.

9. The razor of claim 4, wherein the connector further comprises:

a sidewall part which extends forward from one side of the base part; and one or more locking protrusions which protrude forward from one side of the sidewall part, and wherein a locking projection, which protrudes rearward from the rear of the cartridge main body, supports sides of the locking protrusions.

10. The razor of claim 9, wherein:

the sidewall part comprises one or more insertion grooves at a front side of the sidewall part; and insertion protrusions, which protrude rearward from the rear of the cartridge main body, are inserted into the one or more insertion grooves.

* * * * *